United States Patent [19]

Hetzler et al.

[11] 4,033,129

[45] July 5, 1977

[54] HYDRAULIC FEED CONTROL SYSTEM FOR ROTARY DRILL

[75] Inventors: Robert B. Hetzler, Emlenton; Gerald L. Pierson, Franklin, both of Pa.

[73] Assignee: Chicago Pneumatic Tool Company, New York, N.Y.

[22] Filed: June 1, 1976

[21] Appl. No.: 691,511

[52] U.S. Cl. ..... 60/486; 91/6; 91/444; 91/462

[51] Int. Cl.[2] ..... F15B 13/09; F15B 15/22

[58] Field of Search ..... 60/375, 486; 91/6, 7, 91/30, 415, 444, 462

[56] References Cited

UNITED STATES PATENTS

| | | | |
|---|---|---|---|
| 1,932,7 60 | 10/1933 | West | 60/486 X |
| 2,214,817 | 9/1940 | Harrington | 60/417 X |
| 2,799,138 | 7/1957 | Dornhöfer | 60/375 X |
| 3,171,247 | 3/1965 | McAlvay | 60/486 X |
| 3,472,026 | 10/1969 | Conabee | 60/375 X |

*Primary Examiner*—Edgar W. Geoghegan
*Attorney, Agent, or Firm*—Stephen J. Rudy

[57] ABSTRACT

An hydraulic feed control system for feeding or retracting a rotary rock drill relative to the work in a selected one of four modes; namely, standard feed; regeneration feed; standard retract; and rapid retract. The system includes an hydraulic circuit controlling the feeding and retraction of feed cylinders connected to the drill; a pair of hydraulic pressure supply sources; and a pair of manipulative control valves. A primary one of the valves controls flow from one of the sources directly into the circuit; and the other control valve is selectively operable to direct flow from the other source through the primary valve into the circuit so as to combine the flow from both sources for the regeneration feed and rapid retract modes.

11 Claims, 5 Drawing Figures

HYDRAULIC FEED CONTROL SYSTEM FOR ROTARY DRILL

BACKGROUND OF THE INVENTION

This invention relates to improvements in hydraulic feed systems for rotary drills. More particularly it is concerned with providing an improved and economically advantageous system for rapidly advancing and retracting the rotary head of a conventional rotary rock drill.

Conventional rotary drills in attempting to obtain rapid speed or retract operations increase the pumping capacity of their systems. This arrangement may have an advantage during a portion of the drilling cycle, but can be a detriment at other times; such as, when penetrating hard rock at a relatively slow rate, the excess energy used develops into heat which may be destructive of the hydraulic system.

The system of the present invention is designed to use only the energy required to fulfill the need at a given time.

Accordingly, a feature of the system of the present invention lies in the employment of a pressure compensating type hydraulic pump which functions to feed only the oil required for the drill head to penetrate a given strata at up to the maximum feed rate of the system, all at the driller's predetermined feed pressure. The predetermined feed pressure would be that most economical for the bit size being used.

Another feature of the system lies in the employment of a pilot operated dump valve which will relieve the pulldown/hoist cylinders return oil at the time the cylinders are retracting and the rotary head is in the hoisting mode. The dump valve is arranged to relieve the return oil direct to sump, thereby avoiding the usual return route and associated back pressures. This feature is especially advantageous during a rapid retract mode of retraction since in this mode the system oil is greatly increased by adding to it the rotation system oil flow.

A further feature of the feed system is a pilot operated high capacity directional valve arranged to be actuated by a signal induced only when the oil of the rotation oil system is added to the feed system.

Another feature of the invention lies in the organized arrangement of elements in the hydraulic feed system whereby the latter is selectively operable in various modes; namely, standard feed; regeneration feed; standard retract; and rapid retract.

Various advantages attributable to the system are increased feed and retract speeds that considerably reduce drilling time; capacity of the drill bit to penetrate the strata at maximum speed; materially reduced heat build up and back pressure as a result of routing return oil flow directly to sump at minimum pressure; reduction in wasted horsepower by using pressure compensating and variable volume pumps that work only when required; and accordingly a relatively economical system.

BRIEF DESCRIPTION OF THE DRAWING

In order that the invention may be fully understood and readily carried into effect, it will now be described, by way of example only, with reference to the accompanying drawing, wherein.

DESCRIPTION OF PREFERRED EMBODIMENT

Figure 1:
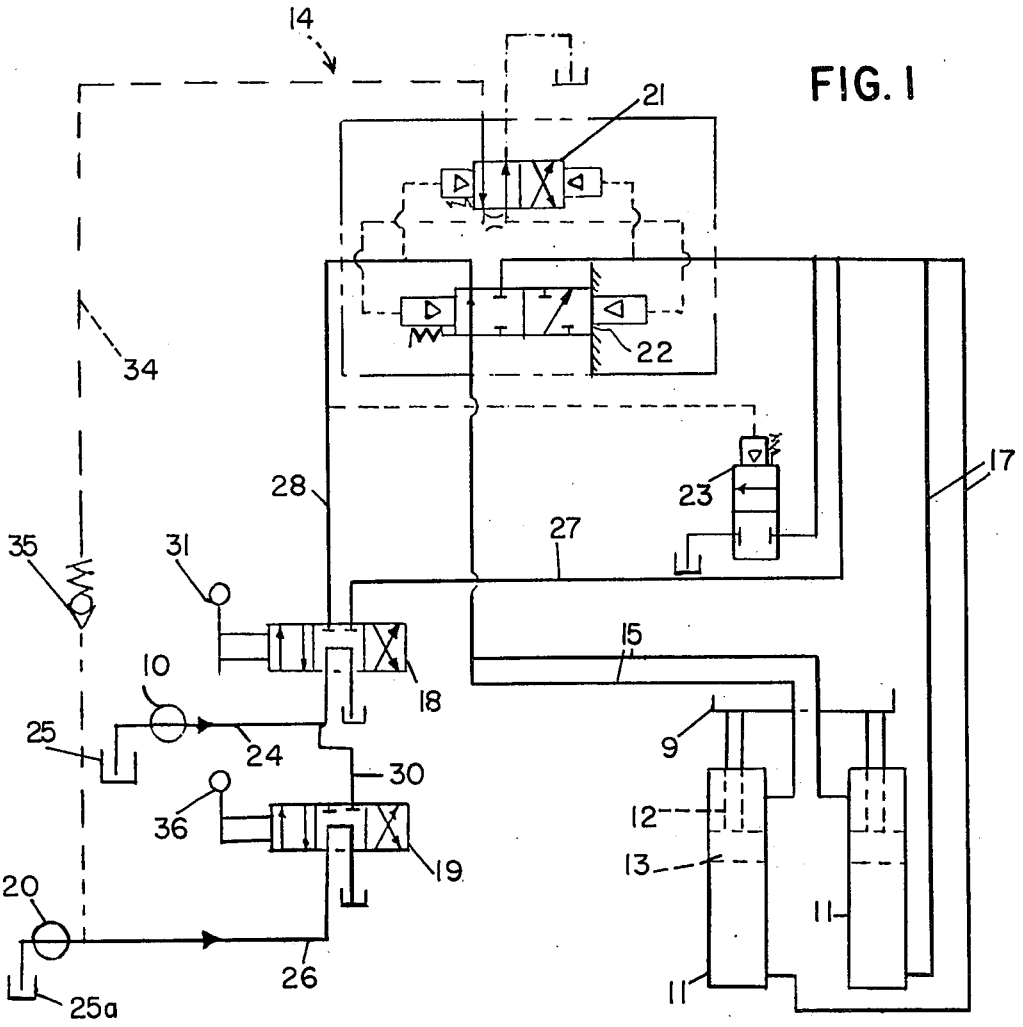
FIG. 1 is a schematic view of an hydraulic feed system embodying the invention for a rotary rock drill, showing the system in its neutral or normal at rest condition.

Referring to the drawing, and now especially to FIG. 1, a preferred embodiment of the invention illustrated therein includes at least one pulldown/hoist hydraulic cylinder 11. Here, the usual pair of such cylinders are provided. These are operable to feed and retract relative to a work object a rock drill, generally indicated at 9, having a rotary head. The head is rotated by the usual hydraulic motor rotation system; and is advanced or retracted relative to the work with the drill.

The rock drill is mounted in conventional manner upon the usual channel track, and is connected to the usual piston rods 12 for pulldown or hoist sliding movement relative to the work, accordingly as pistons 13 are hydraulically advanced or retracted.

The hydraulic feed system controlling operation of cylinders 11 includes an hydraulic circuit, generally designated 14, connected by lines 15 with the retract or piston rod ends of the cylinders, and connected by lines 17 with the feed or butt ends of the cylinders. A pair of control valves 18 and 19 connected in the circuit are selectively manipulative to effect hydraulic operation of the cylinders and, as a consequence, cause feeding or retraction of the drill head in a selected one of either of four modes; namely, a first mode in which feeding of the drill head is at a standard speed; a second mode in which feeding is at a regenerated rapid speed; a third mode in which retraction of the drill head is at a standard speed; and a fourth mode in which retraction is at a rapid speed.

Connected in the circuit between the control valves and the cylinders is a group of integrated pilot operable spring returned valves 21, 22 and 23 which determine the directional flow of hydraulic fluid to and from the cylinders accordingly as the control valves 18 and 19 are operated.

Valve 21 is a two-position directional valve with four connections. Valve 22 is a two-position directional valve with three connections. Valve 23 is a two-position directional valve with two connections, and is referred to herein as a rapid drain or dump valve.

Control valve 18 is referred to herein as a primary valve, since it is operated in the system for each of the selectable modes of operation. It has a primary supply line 24 in which a primary pressure compensating hydraulic feed pump 10 is connected. The pump is adapted to feed operating oil from a sump 25 to the system from 0 – 20 G.P.M. at a feed pressure predetermined by the operator. Valve 18 is a lever operated three position directional valve having four connections and an open center.

Control valve 19 is referred to herein as a secondary valve, since it is operated in the system in conjunction with the primary valve 18, but only when either the regenerated rapid feed mode or the rapid retract mode of operation is selected. It has an individual secondary supply line 26 in which a secondary variable volume feed pump 20 is connected. The latter pump is adapted to feed hydraulic operating oil from a sump 25*a* to the system from 0 – 45 G.P.M. at a feed pressure predetermined by the operator. Valve 19 is a lever operated three position directional valve, but is shown here as having only three connections and an open center. Sump 25 is independent of sum 25*a*. It serves primarily to operate the hydraulic motor in the rotation system for the drill head.

Oil feed to and from cylinders 11 is indicated in the drawing by solid lines. Signal lines to the pilots of valves 21, 22 and 23 are indicated in broken line.

In the neutral or normal at rest condition of the hydraulic system, as indicated in FIG. 1, with the primary and secondary pumps in operation, oil is forced by the primary pump over supply line 24 through the center of valve 18 directly back to sump; and oil is forced by the secondary pump over supply line 26 through the center of valve 19 directly back to sump. Both valves 18 and 19 accordingly are closed to the system in their neutral condition; and the return flow to sump is direct and at a minimum pressure to avoid heat build up.

The primary valve 18 has a direct connection with the system through lines 27 and 28; whereas the secondary valve 19 is only indirectly connected to the system by a line 30 that connects it with the primary supply line 24. In the neutral position of the secondary valve, flow from supply line 26 to line 30 is blocked or shut-off. It is only when the secondary valve is shifted to an operating position that oil from the secondary supply line 26 will feed through line 30 to join with the oil feeding into the system through the primary valve 18.

STANDARD FEED MODE (FIG. 2.)

Figure 2:
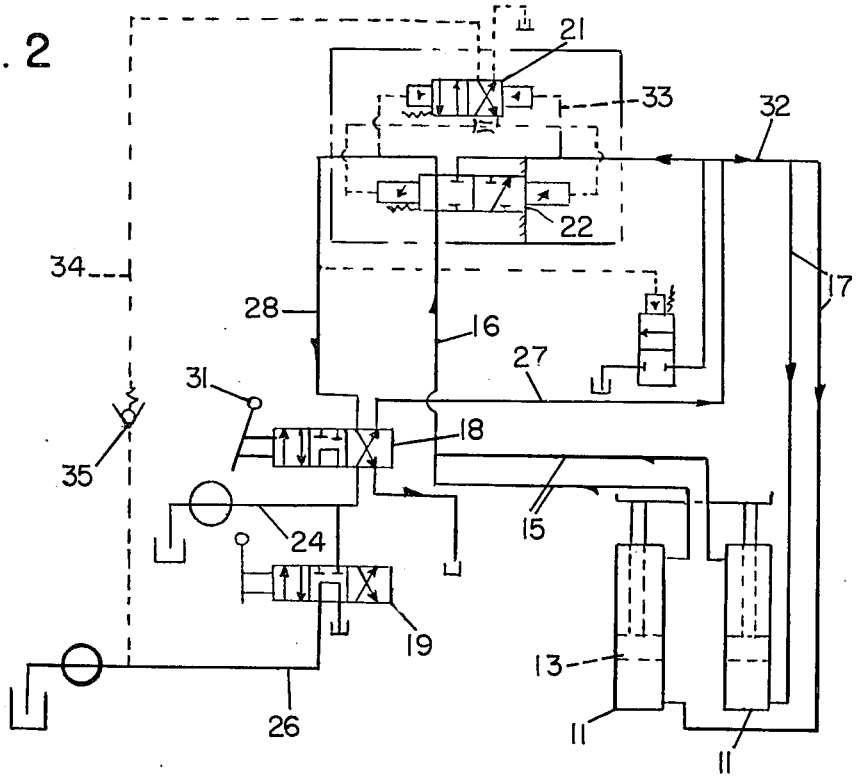
FIG. 2 shows the system of FIG. 1 being operated in a standard feed mode in which the drill is being fed relative to the work at a standard speed.

To effect a standard feed mode of operation of the cylinders, control lever 31, of primary control valve 18 is manually moved forwardly, causing the valve to shift to its right end position as indicated in FIG. 2. At this time the control lever 36 of the secondary control valve 19 is retained in its neutral or normal position.

Oil pumped over supply line 24 will now feed through the right section of valve 18 into line 27. From the latter it flows over lines 32 and 17 to the butt or feed ends of cylinders 11 to pressure the pistons in a feeding direction. It is to be noted that the route from supply line 24 to the cylinders 11 is short and direct.

Signal pressure is sensed at this time from line 32 over pilot line 33 by the pilot at the right end of valve 21, causing the latter to shift to its right position as indicated in FIG. 2. However, since the secondary valve 19 is in its neutral or normal position with its supply line 26 connected directly through its center to sump, pressure in line 34 is inadequate to open the check valve 35 to pass signal pressure through valve 21 to affect the right pilot and condition of valve 22. Accordingly, valve 22 retains its neutral condition.

The neutral condition of valve 22 allows oil being forced by the advancing pistons 13 from the piston rod sides of cylinders 11 into lines 15, and then over line 16 to pass through the left end of valve 22 into line 28; and to drain from the latter through the right section of valve 18 directly to sump. It is also to be noted that the return or drain route of oil from the cylinders to sump is also short and direct.

REGENERATION RAPID FEED MODE (FIG. 3)

Figure 3:
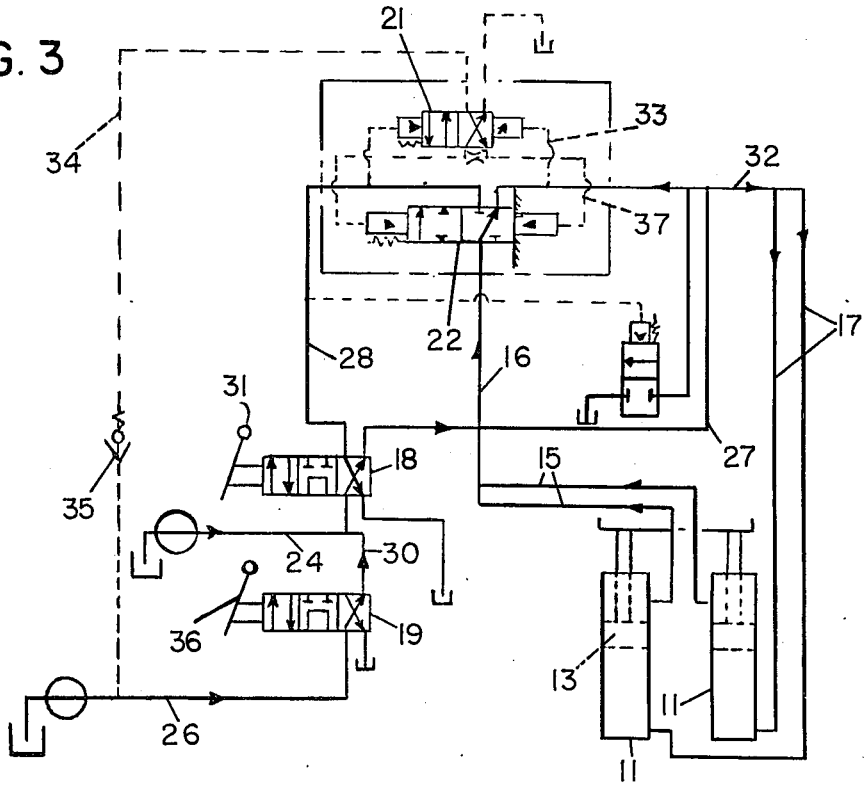
FIG. 3 shows the system of FIG. 1 being operated in a regeneration feed mode in which the drill is being fed relative to the work at a rapid speed.

To effect a regeneration rapid feed operation of cylinders 11, control levers 31 and 36 respectively of the primary and secondary valves 18 and 19 are manually moved forwardly, causing each valve to shift to its right end position as indicated in FIG. 3. The shifting of valve 19 connects its supply line 26 through line 30 with the supply line 24 of valve 18.

Accordingly, the oil then pumped from supply line 26 combines with that being pumped through supply line 24; and the combined oil flows through the right section of valve 18 into line 27. From the latter it flows over lines 32 and 17 to the butt or feed ends of cylinders 11. Pistons 13 are accordingly pressured in a feeding direction by the combined pressures of oil from both supply lines 24 and 26. Here, it is also to be noted that flow from the pumps to the cylinders is short and direct.

Signal pressure is sensed at this time from line 32 over pilot line 33 by the pilot at the right end of valve 21 causing the latter to shift to its right end position, as indicated in FIG. 3. Because of the operation of valve 19 sufficient pressure develops in line 34 to open check valve 35. This causes signal pressure to pass from line 35 through the right section of now shifted valve 21 to pilot line 37 causing valve 22 to shift to its right end position, as indicated in FIG. 3.

The shift in valve 22 permits oil being forced from the piston rod ends of cylinders 11 by the advancing pistons to flow over lines 15 and 16 through the right section of now shifted valve 22 into line 32 to join with and supplement the pressure of oil in lines 17 to the butt or feed ends of the cylinders. In effect, the energy being used in advancing the pistons at one end of the cylinders is regenerated by that imparted by the advancing pistons to the oil at the opposite ends of the cylinders. The ultimate effect is a rapid feeding operation of the pistons and, as a consequence, rapid travel of the drill head.

STANDARD RETRACT MODE (FIG. 4)

Figure 4:
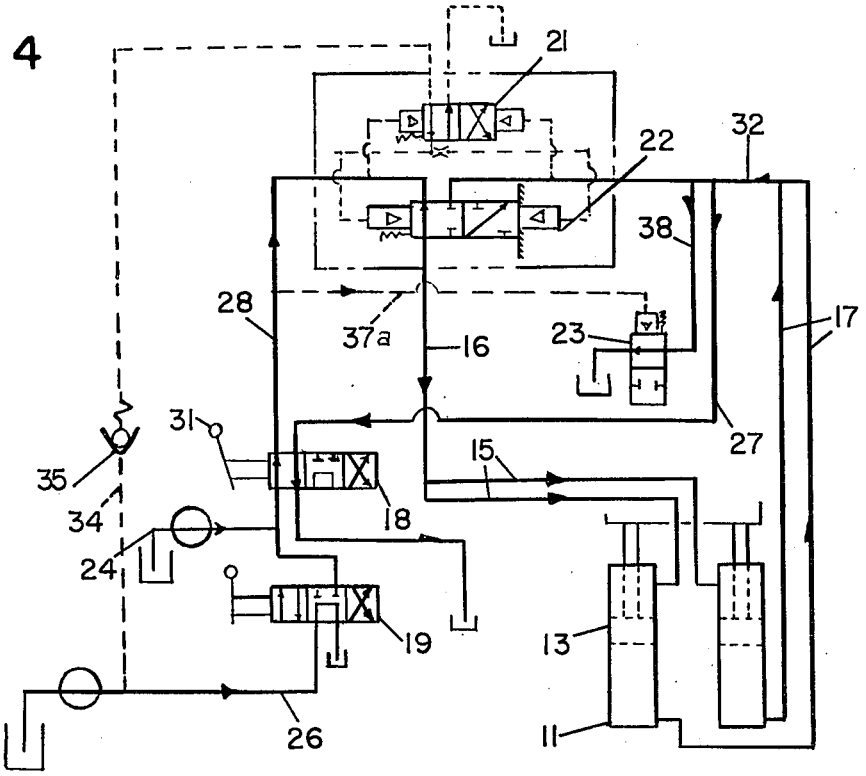
FIG. 4 shows the system of FIG. 1 being operated in a standard retract mode in which the drill is being retracted from the work at a standard speed.

To effect a standard retract mode of operation of cylinders 11, control lever 31 of primary control valve 18 is manually moved rearwardly, causing the valve to shift to its left end position as indicated in FIG. 4. At this time the control lever 36 of the secondary control valve 19 is retained in its neutral position.

Oil then pumped over supply line 24 through the left section of valve 18 into line 28 passes through the left section of valve 22 into line 16. From the latter it flows through lines 15 to the retract or piston rod ends of cylinders 11 to pressure the pistons 13 in a retracting direction.

At this time the check valve 35 in line 34 remains closed because of the neutral condition of valve 19 relaxing the pressure in line 34 to sump. A pressure signal is sensed from line 28 over pilot line 37*a* by the pilot of valve 23, causing the latter to shift to its open or dumping condition as indicated in FIG. 4.

Accordingly, oil being forced by the retracting pistons from the butt ends of cylinders 11 into lines 17 flows into line 32. In line 32 the oil volume divides so that part drains over line 27 and through the left section of valve 18 directly to sump; and a second part drains over line 38 through the dump valve directly to sump.

The direct and short drain route to sump, and the division of the oil volume in draining to sump enables return oil flow with a desirable minimum pressure.

RAPID RETRACT MODE

(FIG. 5)

Figure 5:
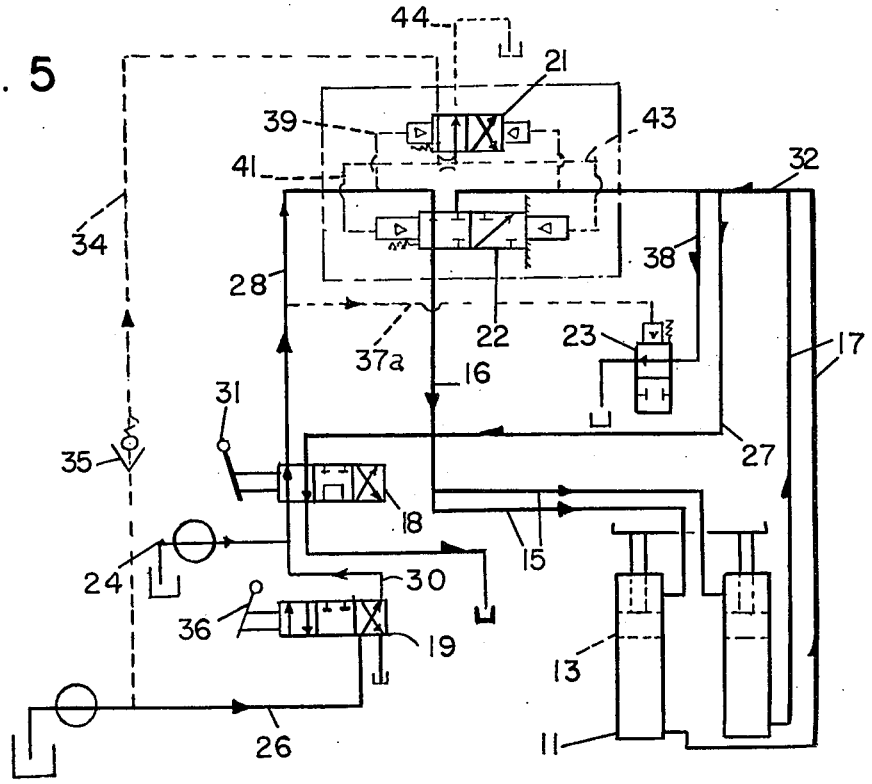
FIG. 5 shows the system of FIG. 1 being operated in a rapid retract mode in which the drill is being retracted from the work at a rapid speed.

To effect a rapid retract mode of operation of cylinders 11, control lever 36 is moved, as in FIG. 5, forwardly to shift the secondary valve 19 to its right end position so as to cause oil pumped through its supply line 26 to pass to line 30 and join with that in supply line 24. Control lever 31 is next moved rearward to shift the primary valve 18 to its left position.

The combined oil now being pumped from supply lines 24 and 26 passes through the left section of valve 18 into line 28.

Signal pressure now sensed from line 28 over pilot line 37*a* by the pilot of dump valve 23 shifts the latter to its open or dump position, as indicated in FIG. 5.

Signal pressure now sensed from line 28 over pilot line 39 by the left pilot of valve 21 does not affect the neutral or normal position of the latter since it is spring returned.

Also signal pressure now opening check valve 35 in line 34 and passing through the left section of valve 21 and pilot line 41 to the left pilot of valve 22 does not affect the neutral or normal condition of the latter since it is spring returned. And the choke between pilot lines 41 and 43 connecting line 34 with sump line 44 at its right end avoids an adequate pressure signal passing from line 34 over line 43 to actuate the right pilot of valve 22.

Accordingly, the combined oil being pumped through valves 19 and 8 into line 28 passes directly through the left section of valve 22 to line 16; and from the latter passes through lines 15 to the retract ends of cylinders 11 to pressure the pistons 13 in a retracting direction.

As the pistons retract, oil at the butt ends of the cylinders is forced over lines 17 to line 32. In line 32 the oil volume divides to drain in part over line 27 and through the left section of valve 18 directly to sump; and to dump in part over line 38 through the dump valve 23 directly to sump.

The combined oil pressure applied in retracting the pistons, together with the short direct and divided volume route with which the oil drains at a desirable minimum pressure from the butt ends of the cylinders, provides a rapid retraction of the feed pistons 13 and, as a consequence, of the rock drill from the work.

We claim:

1. An hydraulic feed control system for hydraulically feeding and retracting a rotary rock drill relative to the work, comprising an hydraulic piston cylinder selectively operable for feeding or retracting the drill, and hydraulic circuit connected to opposite ends of the cylinder for applying fluid to a selected end of the cylinder and simultaneously draining fluid from the opposite end to a sump, an hydraulic feed pump connected for pumping fluid from the sump, a manipulative primary control valve having an inlet connection with a discharge end of the pump and having a discharge connection for admitting fluid from the pump to the circuit, the control valve being selectively operable for determining the end of the cylinder to which fluid from the pump is to be applied, pilot operable directional valve means in the circuit having response to fluid admitted to the circuit in accordance with a selected operation of the control valve to direct the fluid to the selected end of the cylinder to which it is to be applied and to direct fluid from the opposite end of the cylinder back to sump.

2. An hydraulic feed control as in claim 1, wherein the pump is pressure compensating.

3. An hydraulic feed control system as in claim 1, wherein the directional valve means includes a pilot operable dump valve having response to application of the fluid admitted from the pump to the circuit to a selected end of the cylinder in a retracting direction to connect the opposite end of the cylinder directly to sump.

4. An hydraulic feed control system as in claim 3, wherein the control valve when operated to determine application of fluid to a selected end of the cylinder in a retracting direction also communicates said opposite end of the cylinder with sump.

5. An hydraulic feed control system as in claim 1, wherein a manipulative secondary control valve has an inlet connection with a discharge end of a second hydraulic pump and has a discharge connection with the inlet connection to the primary control valve, whereby operation of both control valves causes fluid from both pumps to combine and pass into the circuit.

6. An hydraulic feed control system as in claim 5, wherein the second hydraulic pump is a variable volume pump.

7. An hydraulic feed control system as in claim 5, wherein the directional valve means includes a pilot operable dump valve having response to application of the fluid admitted from the pumps into the circuit to a selected end of the cylinder in a retracting direction to connect the opposite end of the cylinder directly to sump.

8. An hydraulic feed control system as in claim 5, wherein the primary control valve when operated to determine application of fluid to a selected end of the cylinder in a retracting direction also communicates said opposite end of the cylinder with sump.

9. An hydraulic feed control system as in claim 5, wherein, when the primary control valve is operated to determine application of the fluid to an end of the cylinder is a feeding direction, the directional valve means has response to fluid admitted to the circuit to direct the combined fluid to the cylinder in a feeding direction and to direct fluid from the opposite end of the cylinder back to the cylinder in a feeding direction.

10. An hydraulic control system for hydraulically feeding and retracting a rotary rock drill relative to the work, comprising an hydraulic cylinder having a feed end for application of hydraulic fluid to a piston therein to effect feeding of the drill and having an opposite retract end for application of hydraulic fluid to the piston to effect retraction of the drill, an hydraulic circuit connected to the feed and retract ends of the cylinder, an hydraulic pump for pumping fluid from a sump into the circuit, a manipulative primary control valve having an inlet connection with a discharge end of the pump and having a discharge end for admitting fluid from the pump to the circuit, the primary control valve being selectively operable for determining the end of the cylinder to which fluid from the pump is to be applied, pilot operable directional valve means in the circuit having response to fluid admitted to the circuit in accordance with a selected operation of the control valve to direct the fluid to the selected end of the cylinder to which it is to be applied and to direct fluid from the opposite end of the cylinder to sump, a secondary pump for pumping fluid from the sump, and a secondary control valve having an inlet connection with the discharge end of the secondary pump and having a discharge connection with the inlet to the primary control valve, the secondary control valve being selectively operable to combine the fluid from the secondary pump with the fluid from the primary pump at the inlet connection to the primary control valve.

11. An hydraulic control system as in claim 10, wherein the primary control valve when operated to determine application of the fluid to the cylinder in a retracting direction communicates the feed end of the cylinder with sump, and a pilot operable dump valve in the circuit also has response to fluid in the circuit to communicate the feed end of the cylinder with sump.

* * * * *